US011685032B2

(12) United States Patent
Kollmann et al.

(10) Patent No.: US 11,685,032 B2
(45) Date of Patent: Jun. 27, 2023

(54) ROTARY IMPACT TOOL HAVING BIT HOLDING DEVICE

(71) Applicant: MILWAUKEE ELECTRIC TOOL CORPORATION, Brookfield, WI (US)

(72) Inventors: Cody J. Kollmann, Wauwatosa, WI (US); Steven T. Tworek, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/359,791

(22) Filed: Jun. 28, 2021

(65) Prior Publication Data

US 2022/0001523 A1 Jan. 6, 2022

Related U.S. Application Data

(60) Provisional application No. 63/047,534, filed on Jul. 2, 2020.

(51) Int. Cl.
*B25D 17/08* (2006.01)
*B25D 11/04* (2006.01)

(52) U.S. Cl.
CPC ..... *B25D 17/088* (2013.01); *B25D 11/04* (2013.01); *B25D 2217/0042* (2013.01); *B25D 2250/095* (2013.01); *B25D 2250/371* (2013.01)

(58) Field of Classification Search
CPC ..... B25D 17/088; B25D 11/04; B25D 2217/0042; B25D 2250/095; B25D 2250/371
See application file for complete search history.

(56) References Cited

U.S. PATENT DOCUMENTS 4,131,165 A 12/1978 Wanner et al.
4,502,824 A 3/1985 Dohse et al.
(Continued)

FOREIGN PATENT DOCUMENTS

CN 101678545 B 3/2012
CN 103042506 B 2/2016
(Continued)

OTHER PUBLICATIONS

International Search Report and Written Opinion for Application No. PCT/US2021/039306 dated Oct. 19, 2021 (12 pages).

*Primary Examiner* — Andrew M Tecco
*Assistant Examiner* — Nicholas E Igbokwe
(74) *Attorney, Agent, or Firm* — Michael Best & Friedrich LLP

(57) ABSTRACT

A rotary impact tool includes a housing, an electric motor supported in the housing, and a drive assembly. The drive assembly includes an anvil having a longitudinal bore for selectively receiving a tool bit, and a plurality of radial slots extending from the longitudinal bore through the anvil. The rotary impact tool further includes a bit holding device including a plurality of ball detents received in the respective radial slots, and a collar slidably disposed on the anvil having an interior surface for maintaining a portion of the ball detents within the longitudinal bore, and collar spring for biasing the collar rearward to a first collar position. The bit holding device further includes a helical detent spring surrounding the anvil having a continuous helical structure with a plurality of protrusions extending into the radial slots, the protrusions are for biasing the ball detents toward an open end of the bore.

20 Claims, 4 Drawing Sheets

(56) References Cited

U.S. PATENT DOCUMENTS 4,626,146 A 12/1986 Neumaier
4,691,929 A 9/1987 Neumaier et al.
4,858,939 A * 8/1989 Riggs ..... B23B 31/1071 279/22
4,878,679 A 11/1989 Plank et al.
4,900,202 A 2/1990 Wienhold
5,013,194 A 5/1991 Wienhold
5,076,371 A 12/1991 Obermeier et al.
5,199,833 A * 4/1993 Fehrle ..... B25D 17/088 408/239 R
5,603,516 A 2/1997 Neumaier
5,709,391 A 1/1998 Arakawa et al.
6,092,814 A 7/2000 Kageler
6,241,026 B1 6/2001 Wache et al.
6,261,035 B1 7/2001 Moores, Jr. et al.
6,457,916 B2 * 10/2002 Wienhold ..... B25B 23/0035 279/155
6,464,234 B2 10/2002 Frauhammer et al.
6,497,418 B2 12/2002 Yahagi
6,536,780 B2 3/2003 Baumann et al.
6,651,990 B2 11/2003 Higasi et al.
6,820,700 B2 11/2004 Funfer et al.
6,854,740 B2 2/2005 Baumann et al.
7,121,774 B2 10/2006 Hirt et al.
7,131,503 B2 * 11/2006 Furuta ..... B25D 16/006 173/112
7,214,010 B2 5/2007 Hellbach et al.
7,258,349 B2 8/2007 Frauhammer et al.
7,644,929 B2 1/2010 Frauhammer et al.
7,845,428 B2 12/2010 Sakamaki et al.
8,172,235 B2 5/2012 Furusawa et al.
8,201,835 B2 6/2012 Haas
8,210,545 B2 * 7/2012 Hild ..... B23B 31/1071 279/19.6
8,381,830 B2 * 2/2013 Puzio ..... B25B 23/0035 173/132
8,459,658 B2 6/2013 Cycon
8,590,905 B2 11/2013 Furusawa et al.
8,622,401 B2 1/2014 Puzio et al.
8,800,999 B2 * 8/2014 Puzio ..... B23B 31/107 279/75
8,820,431 B2 9/2014 Puzio et al.
9,067,266 B2 6/2015 Puzio et al.
9,242,422 B2 1/2016 Schweizer et al.
9,434,057 B2 9/2016 Funk et al.
9,434,119 B2 9/2016 Schweizer et al.
9,469,020 B2 10/2016 Funk et al.
9,566,696 B2 2/2017 Yew et al.
9,573,263 B2 2/2017 Bowles et al.
9,573,335 B2 2/2017 Schweizer et al.
9,676,038 B2 6/2017 Hauptmann
9,999,968 B2 6/2018 Selvanayagam et al.
10,112,239 B2 10/2018 Hoelz
10,286,456 B2 5/2019 Shi et al.
2007/0024013 A1 2/2007 Hauptmann et al.
2010/0237572 A1 9/2010 Casel
2011/0233878 A1 * 9/2011 Wan ..... B25B 23/0035 279/9.1
2012/0193115 A1 8/2012 Hild et al.
2014/0312578 A1 * 10/2014 Puzio ..... B25B 23/0035 279/29
2016/0031017 A1 * 2/2016 Peters ..... B23B 31/107 279/145

FOREIGN PATENT DOCUMENTS

DE 4210911 A1 10/1993
DE 19634707 A1 3/1998
DE 19708176 A1 9/1998
DE 102004016014 A1 10/2005
DE 10031938 B4 3/2006
DE 19914577 B4 5/2006
DE 202014006811 U1 11/2015
DE 102015204806 A1 12/2015
EP 1506843 A1 2/2005
JP 2007144618 A 6/2007

* cited by examiner

ROTARY IMPACT TOOL HAVING BIT HOLDING DEVICE

CROSS-REFERENCE TO RELATED APPLICATIONS

This application claims priority to U.S. Provisional Patent Application No. 63/047,534 filed on Jul. 2, 2020, the entire content of which is incorporated herein by reference.

FIELD OF THE INVENTION

The present invention relates to rotary power tools, and more particularly to rotary power tools having bit holding devices for removably receiving tool bits.

BACKGROUND OF THE INVENTION

Rotary power tools typically include bit holding devices to allow the power tool to be used with any number of interchangeable tool bits. Such tool bit devices usually require two hands to change a tool bit, one hand to pull back on a collar of the bit holding device, and the other hand to insert/remove the tool bit from a bore. However, if a user is constantly changing tool bits, this two-handed action proves to be slow and inefficient.

SUMMARY OF THE INVENTION

The present invention provides, in one aspect, a rotary impact tool comprising a housing, an electric motor supported in the housing, and a drive assembly for converting a continuous torque input from the motor to consecutive rotational impacts upon a workpiece. The drive assembly includes an anvil having a longitudinal bore for selectively receiving one of a plurality of interchangeable tool bits, and a plurality of radial slots extending from the longitudinal bore through the anvil. The rotary impact tool further includes a bit holding device for selectively receiving a plurality of interchangeable tool bits including a plurality of ball detents received in the respective radial slots, and a collar slidably disposed on the anvil having an interior surface configured to maintain at least a portion of the ball detents within the longitudinal bore, and collar spring configured to bias the collar rearward to a first collar position. The bit holding device further includes a helical detent spring surrounding the anvil having a continuous helical structure with a plurality of protrusions extending into the respective radial slots, the protrusions are configured to bias the respective ball detents toward an open end of the longitudinal bore.

The present invention provides, in another aspect, a rotary impact tool including a drive assembly having an anvil with a longitudinal bore for selectively receiving one of a plurality of interchangeable tool bits, a plurality of radial slots extending from the longitudinal bore through the anvil, and a bit holding device for selectively receiving one of the plurality of interchangeable tool bits. The bit holding device includes a plurality of ball detents received in the respective radial slots, and a helical detent spring surrounding the anvil having a continuous helical structure with a plurality of protrusions extending into the respective radial slots configured to bias the respective ball detents toward an open end of the longitudinal bore.

The present invention provides, in yet another aspect, a rotary impact tool including a drive assembly for converting a continuous torque input from the motor to consecutive rotational impacts upon a workpiece. The drive assembly includes an anvil having a longitudinal bore for selectively receiving one of a plurality of interchangeable tool bits, a plurality of radial slots extending from the longitudinal bore through the anvil and formed opposite each other on the anvil, and a bit holding device for selectively receiving one of the plurality of interchangeable tool bits. The bit holding device includes a plurality of ball detents received in the respective radial slots, a collar slidably disposed on the anvil having an interior surface configured to maintain at least a portion of the ball detents within the longitudinal bore, a collar spring configured to bias the collar rearward to a first collar position, and a helical detent spring surrounding the anvil having a plurality of protrusions extending into the respective radial slots. The protrusions are configured to bias the respective ball detents into engagement with one of the plurality of interchangeable tool bits to form multiple contact points between one of the tool bits and the holding device to retain one of the tool bits within the longitudinal bore.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
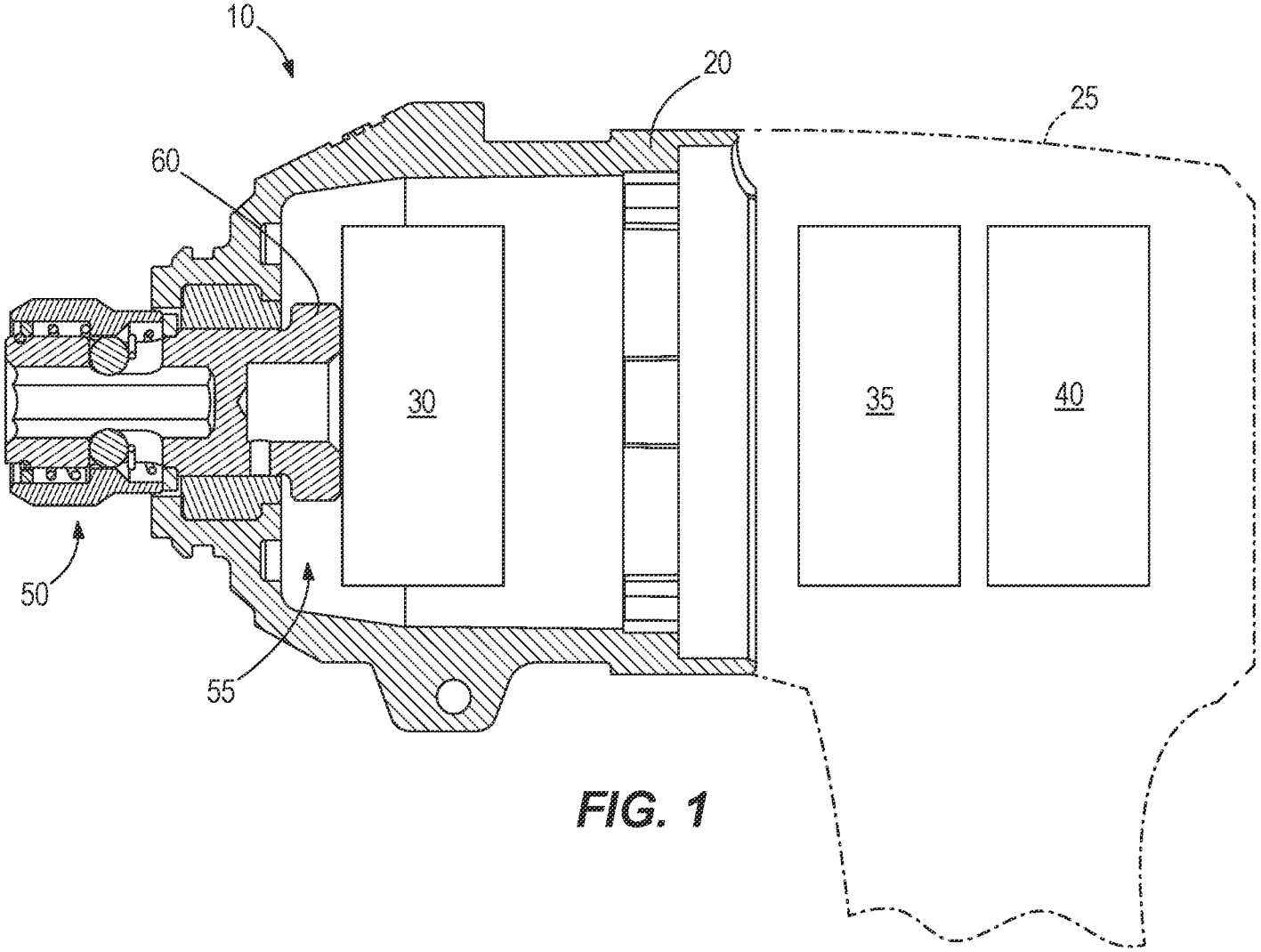
FIG. 1 is a cross-sectional view of a rotary impact tool in accordance with an embodiment of the invention.

FIG. 1 illustrates a power tool in the form of a rotary impact tool or impact driver 10. The impact driver 10 includes a motor housing 25 in which an electric motor 40 is supported, a gear train 35, and an impact case 20 partially housing a rotary impact mechanism 55. The gear train 35 and the impact mechanism 55 are part of a drive assembly for converting a continuous torque input from the motor 40 to consecutive rotational impacts upon a workpiece.

The impact mechanism 55 includes an anvil 60 upon which a bit holding device 50 is supported, which facilitates retention and removal of a tool bit 37 (FIG. 5) from the anvil 60, as described in further detail below. The impact mechanism 55 further includes a hammer 30 configured to repeatedly strike the anvil 60 and the attached the tool bit 37 in order to perform work on the workpiece (e.g., a fastener).

Figure 3:
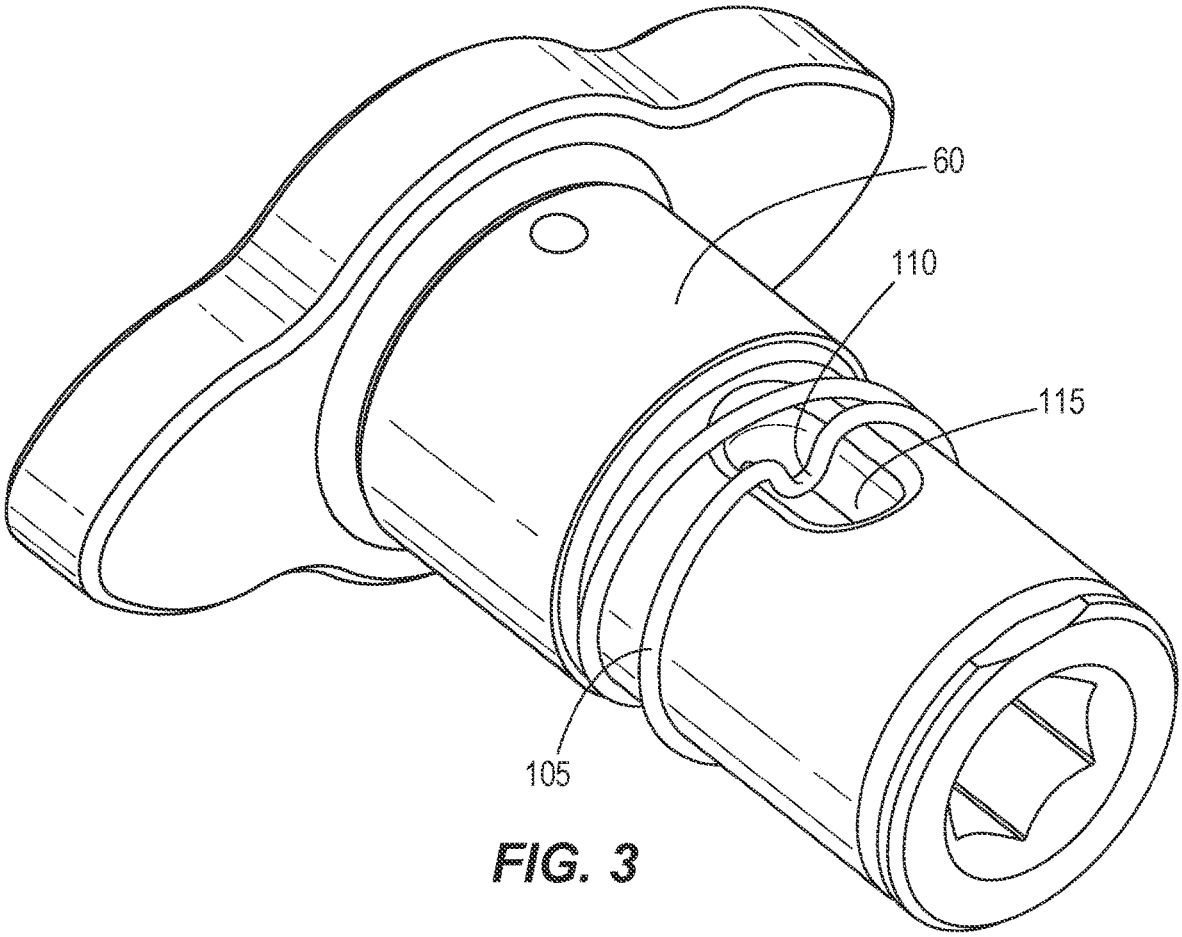
FIG. 3 is a perspective, partial cut-away view of the bit holding device of FIG. 2.
Figure 4:
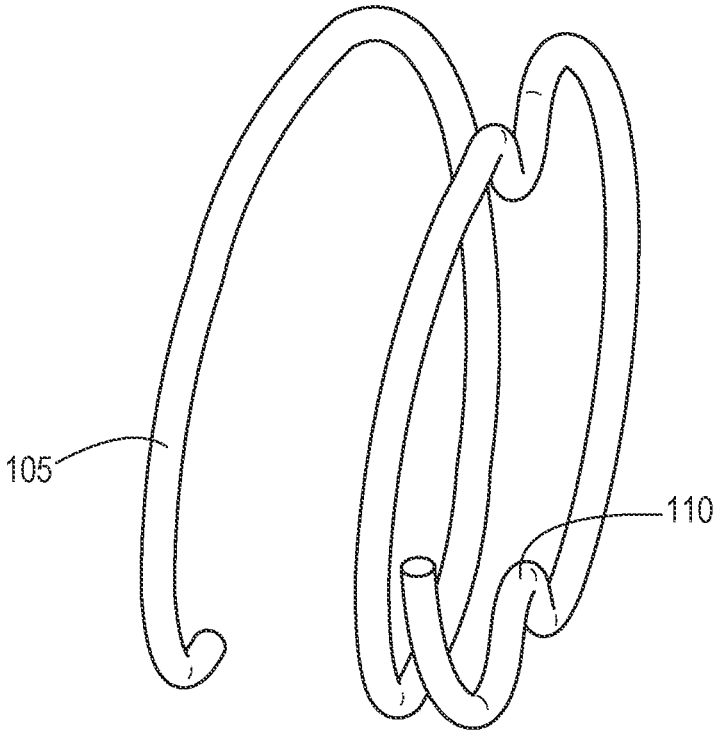
FIG. 4 is a perspective view of a detent spring for use with the bit holding device of FIG. 2.
Figure 5:
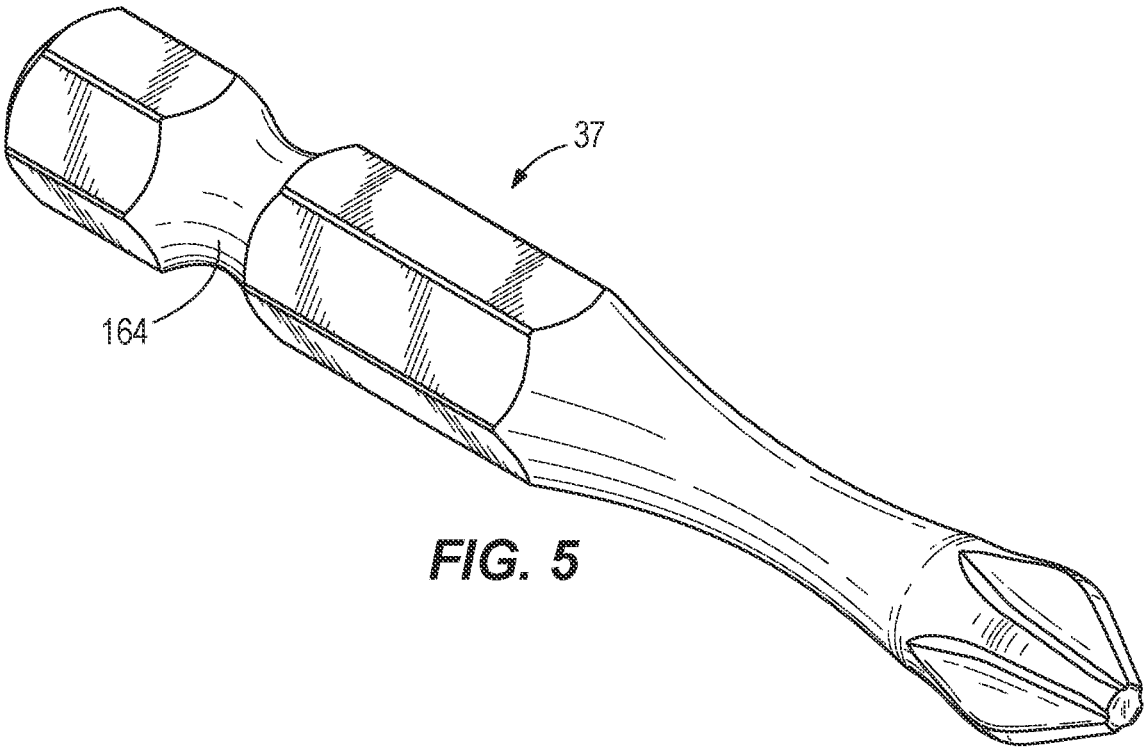
FIG. 5 is a perspective view of a tool bit for use with the impact tool of FIG. 1.

With respect to FIGS. 2-5, the drive assembly includes the anvil 60 having a longitudinal bore 75 with a hexagonal cross-sectional shape for receiving the tool bit 37 (FIG. 5).

The anvil 60 further includes a plurality of radial slots 115 that extend from the longitudinal bore 75 through the anvil 60. The bit holding device 50 includes a plurality of ball detents 100 received in the respective radial slots 115, a collar 70 slidably disposed on the anvil 60, a collar spring 95 that biases the collar 70 rearward to a first collar position (FIG. 2), and a washer 85 and retaining ring 90 that maintain the collar spring 95 on the anvil 60. The collar 70 further includes an interior ring 80 having an inner diameter sized to maintain at least a portion of each of the respective ball detents 100 within the longitudinal bore 75, which, in turn, are received within a circumferential groove 164 (FIG. 5) of the tool bit 37 to secure the tool bit 37 within the anvil 60. The bit holding device 50 also includes a detent spring 105 positioned around the anvil 60 having a plurality of protrusions 110 that extend into the respective radial slots 115 for biasing the respective ball detents 100 toward the front of the respective radial slots 115 and toward the open end of the longitudinal bore 75.

With respect to FIGS. 3 and 4, the detent spring 105 includes a continuous helical structure that extends along the anvil 60 having the protrusions 110 integrally formed as part of the continuous helical structure. In some embodiments of the impact driver 10, the protrusions 110 can be in the form of U-shaped fingers extending into the plurality of radial slots 115.

In operation, to secure the tool bit 37 within the anvil 60, while the collar 70 is in the first position (FIG. 2), a user inserts the end of the tool bit 37 having the circumferential groove 164 within the longitudinal bore 75 using a single hand, pushing the tool bit 37 toward the ball detents 100. Continued insertion of the tool bit 37 causes the rear of the tool bit 37 to engage the ball detents 100, thereby pushing the ball detents 100 rearward until the ball detents 100 clear the interior ring 80, at which point continued insertion of the tool bit 37 displaces the ball detents 100 radially outward and outboard of the tool bit 37. As the ball detents 100 encounter the circumferential groove 164 of the tool bit 37, the detent spring 105 partially rebounds and pushes the ball detents 100 underneath the interior ring 80 to secure the tool bit 37 to the anvil 60.

To release the tool bit 37, the user grasps the collar 70 and moves the collar 70 forward toward the open end of the longitudinal bore 75. The interior ring 80 is moved forward with the collar 70, misaligning the interior ring 80 from the ball detents 100 and allowing the user to pull the tool bit 37 from the bore 75. This action displaces the ball detents 100 radially outward within the slots 115, thereby permitting the tool bit 37 to slide under the ball detents 100 and be removed.

Only requiring the user to use one hand when inserting the tool bit 37 into the device 50 is not only more efficient, but also more convenient because it allows the user to have the other hand free. Additionally, only requiring the user to actuate the collar 70 when removing the tool bit from the device 50 allows for faster interchangeability of the tool bits 37.

Figure 2:
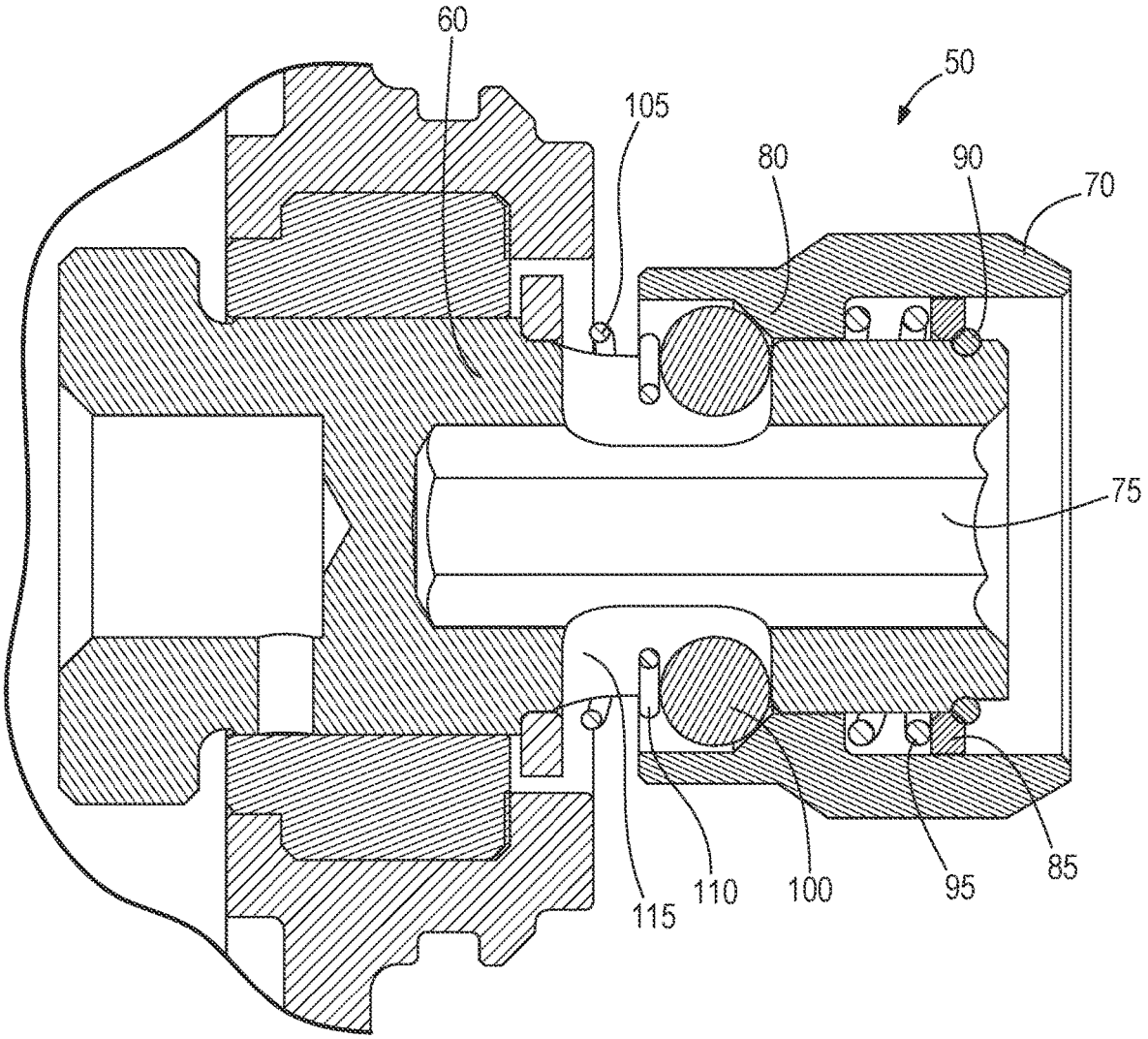
FIG. 2 is an enlarged cross-sectional view of a bit holding device of the impact tool of FIG. 1.

With reference to FIGS. 2 and 5, the plurality of ball detents 100 of the bit holding device 50 provide multiple contact points in the circumferential groove 164 of the tool bit 37; therefore, increasing the resistance between the bit holding device 50 and the tool bit 37. With this increased resistance, the tool bit 37 is prevented from prematurely releasing during certain operating conditions of the tool 10, such as high vibration. Additionally, the bit holding device 50 can provide increased tool bit 37 retention at a much lower cost than other methods presented in the art.

Various features of the invention are set forth in the following claims.

What is claimed is:

1. A rotary impact tool comprising:
- a housing;
- an electric motor supported in the housing;
- a drive assembly for converting a continuous torque input from the motor to consecutive rotational impacts upon a workpiece, the drive assembly including an anvil having
  - a longitudinal bore for selectively receiving one of a plurality of interchangeable tool bits, and
  - a plurality of radial slots extending from the longitudinal bore through the anvil; and
- a bit holding device for selectively receiving one of the plurality of interchangeable tool bits, the bit holding device including
  - a plurality of ball detents received in the respective radial slots,
  - a collar slidably disposed on the anvil, the collar having an interior surface configured to maintain at least a portion of the ball detents within the longitudinal bore,
  - a collar spring configured to bias the collar rearward to a first collar position, and
  - a helical detent spring surrounding the anvil having
    - a continuous helical structure with a first end and an opposite second end, wherein the first and second ends are located outside the radial slots, and
    - a plurality of protrusions located between the first and second ends and extending into the respective radial slots, wherein the protrusions are configured to bias the respective ball detents toward an open end of the longitudinal bore.

2. The rotary impact tool of claim 1, wherein the protrusions are U-shaped fingers.

3. The rotary impact tool of claim 1, wherein the radial slots are arranged opposite each other on the anvil.

4. The rotary impact tool of claim 1, wherein the protrusions are arranged opposite one another.

5. The rotary impact tool of claim 1, wherein one of the interchangeable tool bits includes a circumferential groove.

6. The rotary impact tool of claim 5, wherein the ball detents provide a plurality of contact points between the circumferential groove and the bit holding device.

7. The rotary impact tool of claim 1, wherein the protrusions extend into a rearward portion of the respective radial slots.

8. The rotary impact tool of claim 1, wherein the collar is configured to be slidable on the anvil to a second collar position against the bias of the collar spring toward the open end of the longitudinal bore.

9. The rotary impact tool of claim 8, wherein, when the collar is moved from the first collar position to the second collar position, the interior surface of the collar is moved toward the open end of the longitudinal bore, permitting the ball detents to move radially outward from the respective radial slots.

10. A rotary impact tool comprising:
- a drive assembly including an anvil having
  - a longitudinal bore for selectively receiving one of a plurality of interchangeable tool bits, and
  - a plurality of radial slots extending from the longitudinal bore through the anvil; and
- a bit holding device for selectively receiving one of the plurality of interchangeable tool bits, the bit holding device including a plurality of ball detents received in the respective radial slots, a helical detent spring surrounding the anvil having a continuous helical structure with a first end and an opposite second end, wherein the first and second ends are located outside the radial slots, and a plurality of protrusions located between the first and second ends and extending into the respective radial slots, wherein the protrusions are configured to bias the respective ball detents toward an open end of the longitudinal bore.

11. The rotary impact tool of claim 10, further comprising:

a collar slidably disposed on the anvil, the collar having an interior surface configured to maintain at least a portion of the ball detents within the longitudinal bore; and a collar spring configured to bias the collar rearward to a first collar position.

12. The rotary impact tool of claim 11, wherein, when the collar is in the first collar position, the ball detents are engaged with the tool bit forming a plurality of contact points.

13. The rotary impact tool of claim 10, further comprising:

a housing; and an electric motor supported within the housing.

14. The rotary impact tool of claim 10, wherein the protrusions are U-shaped fingers.

15. The rotary impact tool of claim 10, wherein the radial slots are arranged opposite each other on the anvil.

16. The rotary impact tool of claim 10, wherein the protrusions are arranged opposite one another.

17. A rotary impact tool comprising:

a drive assembly for converting a continuous torque input from the motor to consecutive rotational impacts upon a workpiece, the drive assembly including an anvil having a longitudinal bore for selectively receiving one of a plurality of interchangeable tool bits, and a plurality of radial slots extending from the longitudinal bore through the anvil, the plurality of radial slots formed opposite each other on the anvil; and a bit holding device for selectively receiving one of the plurality of interchangeable tool bits, the bit holding device including a plurality of ball detents received in the respective radial slots, a collar slidably disposed on the anvil, the collar having an interior surface configured to maintain at least a portion of the ball detents within the longitudinal bore, a collar spring configured to bias the collar rearward to a first collar position, and a helical detent spring surrounding the anvil having a continuous helical structure with a first end and an opposite second end, wherein the first and second ends are located outside the radial slots, and a plurality of protrusions located between the first and second ends and extending into the respective radial slots, wherein the protrusions are configured to bias the respective ball detents into engagement with one of the plurality of interchangeable tool bits to form multiple contact points between one of the tool bits and the holding device to retain one of the tool bits within the longitudinal bore.

18. The rotary impact tool of claim 17, wherein the helical detent spring further includes a continuous helical structure surrounding the anvil.

19. The rotary impact tool of claim 17, further comprising:

a housing; and an electric motor supported within the housing.

20. The rotary impact tool of claim 17, wherein the protrusions are U-shaped fingers.

* * * * *